United States Patent [19]

Detalle

[11] 4,165,847

[45] Aug. 28, 1979

[54] TAIL UNIT FOR A MISSILE

[75] Inventor: Bernard A. Detalle, L'Hay-les-Roses, France

[73] Assignee: Societe Europeenne de Propulsion, Puteaux, France

[21] Appl. No.: 803,946

[22] Filed: Jun. 6, 1977

[30] Foreign Application Priority Data

Jun. 25, 1976 [FR] France ..... 76 19432

[51] Int. Cl.[2] ..... F42B 13/32

[52] U.S. Cl. ..... 244/3.29

[58] Field of Search ..... 244/3.23, 3.24, 3.29

[56] References Cited

U.S. PATENT DOCUMENTS

| | | | |
|---|---|---|---|
| 2,485,870 | 10/1949 | Edson | 244/3.23 |
| 2,700,337 | 1/1955 | Cumming | 244/3.23 |
| 2,858,765 | 11/1958 | Startzell | 244/3.29 |
| 3,125,956 | 3/1964 | Kongelbeck | 244/3.29 |
| 3,964,696 | 6/1976 | Orzechowski | 244/3.29 |
| 4,004,514 | 1/1977 | Daniels | 244/3.29 |

FOREIGN PATENT DOCUMENTS

| | | | |
|---|---|---|---|
| 112718 | 1/1918 | United Kingdom | 244/3.29 |

*Primary Examiner*—Verlin R. Pendegrass

*Attorney, Agent, or Firm*—Dennison, Dennison, Meserole & Pollack

[57] ABSTRACT

Tail unit for a missile comprising at least one system of two pairs of curved blades, whereof one of the longitudinal edges is fixed to the periphery of a cylindrical body, whereby the blades of the same pair are symmetrical relative to the axis of said body are fixed to the latter in two diametrically opposite zones and have their concavity turned in the same direction about the axis of said body, wherein the orientation of the concavity of the blades of the same pair of blades around the axis of the cylindrical body is opposite to that of the blades of the other pair.

The said tail unit makes it possible to improve the stability of the trajectory of the missile on which it is mounted, when a rotary movement is given to the missile.

10 Claims, 4 Drawing Figures

TAIL UNIT FOR A MISSILE

BACKGROUND OF THE INVENTION

The present invention relates to a tail unit for a missile, such as a rocket which is to be propelled, at supersonic speed.

Rockets are generally stabilized by means of straight or curved blades fixed to the periphery of a cylindrical body which can constitute the actual missile body or a sleeve mounted thereon. The curved blades of known tail units all have their concavity turned in the same direction around the cylindrical body.

In flight a rocket is subject to a periodic pitching movement, to an imposed rotational rolling movement to compensate aerodynamic mass or propulsive asymmetries and to a disturbing yawing movement.

Curved blades have in the air an asymmetrical flow which produced a lateral force perpendicular to the plane of incidence. At low speeds this force is negligible and does not significantly disturb the flight of the rocket. At high speeds above e.g. Mach 2 this force reaches high values and produces a linking of yawing and pitching movements leading to a precession movement which causes serious disturbances to the rocket trajectory.

BRIEF SUMMARY OF THE INVENTION

The problem of the present invention is to provide a tail unit which does not have such a disadvantage.

This problem is solved by a tail unit for a missile which is propelled at supersonic speed of the type comprising a system of a least two pairs of curved blades, whereof one of the longitudinal edges is connected to the periphery of a cylindrical body and means for producing a rotary torque which rotates the tail unit in flight, each blade being pivoted about a pivot pin integral with the cylindrical body and located in the immediate vicinity of the periphery of the latter and having a curvature which substantially corresponds to that of the body, the length of the circular arc defined by the transverse profile of a blade being between quarter and half the length of the periphery of a cross-section of the cylindrical body, wherein the orientation of the concavity of the blades of one and the same pair of blades about the axis of the cylindrical body is opposite to that of the blades of the other pair of blades and the blades can be folded down onto one another pairwise parallel to the outer surface of the body by rotation about said pivot pins.

Thus, two adjacent blades belonging to two different pairs of blades are symmetrical to one of the bisecting planes of the dihedron formed by the two half-planes passing through the axis of the body and respectively by each of the longitudinal edges of the blades positioned along the cylindrical body.

Consequently when in flight the missile rotates on itself the curved blades which are symmetrical to two planes passing through the axis of the missile permit a change of sign of the lateral force four times per rotation, so that the resulting lateral force for one rotation is zero. Thus, there is a significant improvement in the stability of the missile trajectory. Moreover, the tail unit according to the invention permits the development of large blades and in the folded position is no more cumbersome than a conventional stabilizer, because the blades can be folded onto one another in pairs parallel to the outer surface of the body.

The speed with which the tail unit rotates on itself in flight is fundamental for obtaining the cancelling out of the resulting lateral force. In order to maintain the rotation of the missile on itself folded down edges can be provided on the trailing edge of the blades of one or several pairs of blades and/or chamfers can be made on the leading edges of the blades of one or several pairs of blades.

According to another feature of the invention the blades of one pair, viewed in the direction of the longitudinal axis of the body and in the direction opposite to that of the in flight displacement of the tail unit have a visible or leading surface differing from that of the blades of the other pair in such a way that it causes the tail unit to rotate on itself in flight.

According to a special embodiment the blades of one pair have along their rear edge a trailing edge or portion, folded from the side of the concave face of the blades.

In the tail unit according to the invention each blade can be mounted on the body on a pivot pin parallel to that of the sleeve and have a curvature substantially corresponding to that of the body, the blades being foldable parallel to the outer surface of the body by rotation about pivot pins and the blades being foldable one on to the other in pairs, whereby each group of blades which can be folded on to the other comprises two adjacent blades of two different pairs.

However, according to a special embodiment the articulation axis of the blades can be inclined relative to the axis of the cylindrical body, so that the blades can be given a deflection which maintains the rotation. In this case it is not necessary for the blades to have a chamfered leading edge and/or a trailing edge.

Locking means are provided for maintaining the blades in the opened out position. According to a special embodiments elastic means are provided for maintaining each opened out blade in the locked position with said lug engaged in said recess.

According to a feature of the invention the angle between the axial plane of the body passing through the pivot axes of the two blades of the same pair and the axial plane of the body passing through the pivot pins of the two blades of the other pair differs by 90°.

BRIEF DESCRIPTION OF THE DRAWINGS

Other features and advantages of the invention can be gathered from reading the following description of an exemplified, non-limitative embodiment of the invention, with reference to the attached drawings, wherein show.

DETAILED DESCRIPTION OF THE PREFERRED EMBODIMENTS

Figure 1:
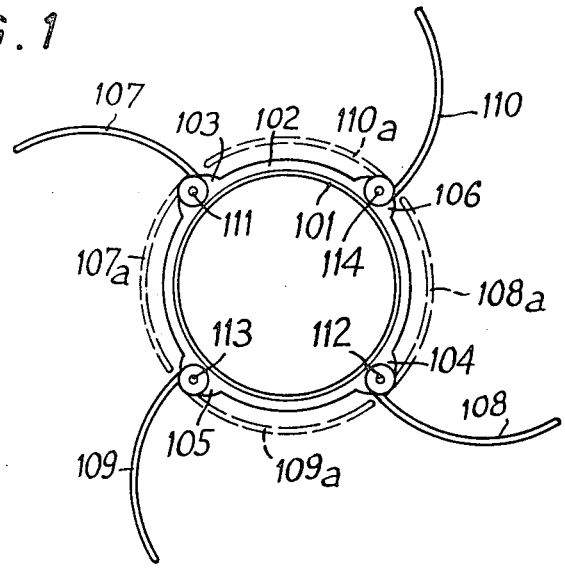
FIG. 1 a diagrammatic rear view in elevation of a missile equipped with a known tail unit.

FIG. 1 shows in a very diagrammatic manner a conventional method for stabilizing a missile 101 using a tail unit mounted on a cylindrical sleeve 102 located on the periphery of missile 101. The tail unit comprises four blades 107, 108,109,110, which can be straight or curved (as shown in FIG. 1). Blades 107–110 can pivot about pivot pins 111–114, respectively fixed to members 103–106, integral with sleeve 102. Blades 107–110 are shown in solid lines in their opened out position and in dotted lines in their folded down positions 107*a*–110*a*. All the curved blades 107–110 have their concavity turned in the same direction relative to the missile axis and in the folded down position substantially adopt the shape of the body of rocket 101. Thus, the various blades 107–110 have no plane of symmetry which passes through the missile axis. Pivots 111–114 are positioned diametrically opposite in pairs relative to sleeve 102. Two diametrically opposite blades (107 ∝ 110) are symmetrical relative to the missile axis. The four blades 107–110 are regularly distributed over the periphery of missile 101 and two adjacent pivot axes form an angle of 90° with the missile axis.

In the case of such a construction the length of the blades 107–110 is limited to about a quarter the length of the outer circumference of the sleeve. Moreover, the lateral force exerted on the blades when the in flight missile rotates on itself always has the same sign due to the asymmetry of the blades, which disturbs the stability of movement of the missile.

Figure 2:
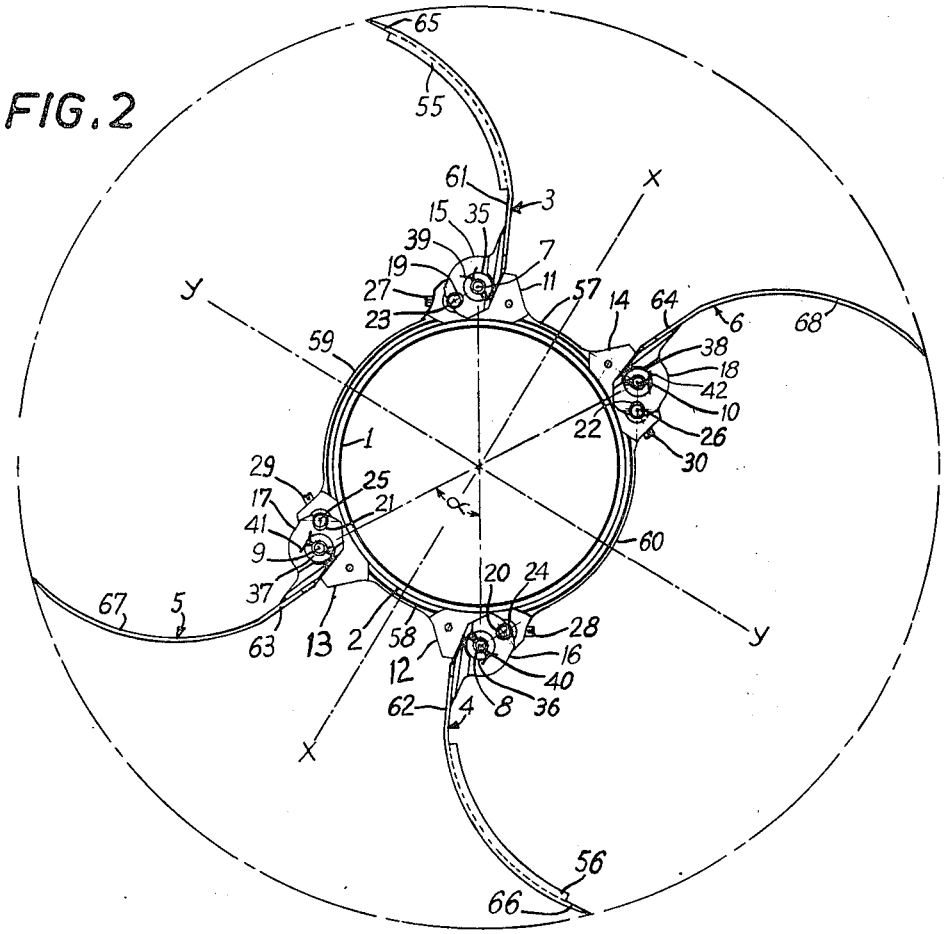
FIG. 2 a rear view of a missile equipped with a tail unit according to the invention with the blades in the opened out position.

FIG. 2 shows an embodiment of the tail unit according to the invention with blades in the opened out position. A cylindrical sleeve 2 is placed in conventional manner around missile 1. Two pairs of blades 3, 4 and 5, 6 are integral with the sleeve 2. The two blades of one pair are attached to the sleeve by one of their edges in two diammetrically opposite zones. Blades 3–6 can pivot respectively about their pins 7–10 positioned parallel to the longitudinal direction of the sleeve and mounted in pairs of blacks 11–14 integral with sleeve 2 and projecting relative to the latter. Each blade can pivot about its pivot pin by at least two hinge members 15–18 (cf FIGS. 2 and 3). A slot 19–22 is provided in each of the hinge members 15–18 and permits the locking of each blade in the opened out position by means of a detachable lug 23–26 respectively mounted in a tube 69–72 (FIG. 4) integral with block 11–14 and held in position by the action of not shown springs and screws 27–30 respectively.

One pair of springs 31–34 is placed round each pivot pin 7–10 (FIG. 3) and serves to open the blades 3–6. Each spring 31–34 has a first end 47–50 engaged in a hole 43–46 provided in a block 11–14 and a second end 51–54 integral with the corresponding blade 3–6.

A system comprising washers 35–38 and pins 39–42 maintains pivot pins 7–10 in a longitudinal position. Projections 11–14 of sleeve 2 are interconnected by strips 57–60, which are parallel to the latter.

The angle $\alpha$ between the axial plane passing through the two pivot pins 7,8 of the first pair of blades 3,4 and the axial plane passing through the two pivot pins 5,6 of the second pair of blades 5,6 preferably differs by 90°. Thus, the blades are not regularly distributed on the periphery of sleeve 2, whilst remaining symmetrical relative to the two axial planes X—X and Y—Y of the projectile.

Figure 4:
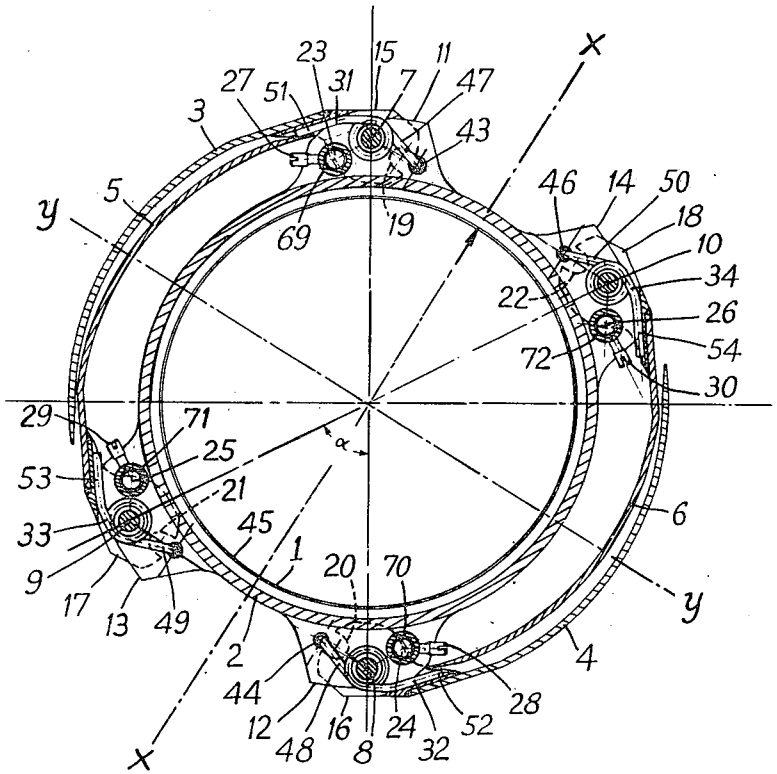
FIG. 4 a cross-sectional view of the missile of FIG. 3 along the line IV—IV of FIG. 3.
Figure 3:
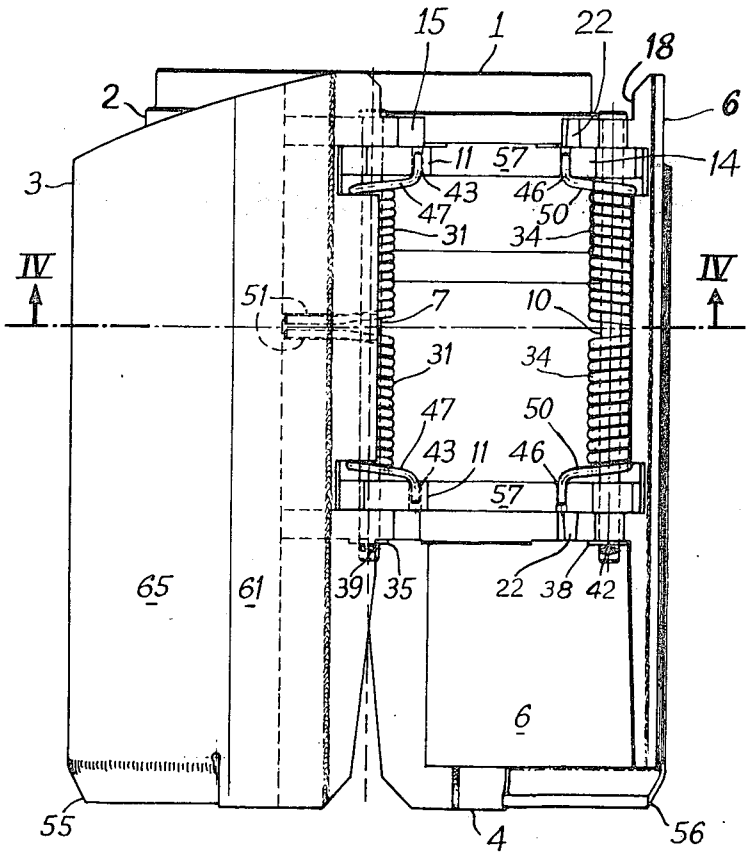
FIG. 3 a plan view of the missile of the FIG. 2 in which the tail unit blades are in the folded down position.

In FIGS. 3 and 4 blades 3–6 are in the folded down position. During the closing of the blades unlocking is effected by removing lugs 23–26 engaged in slots 19–22 of articulations 15–18 of blades 3–6. The latter are brought into and maintained in a position parallel to the body of the missile 1.

Two adjacent blades belonging to two different pairs of blades 3,5 and 4,6 are folded onto one another (FIG. 4). When a value below 90° is given to angle $\alpha$ blades 3–6 can have a transverse profile with an arc whose length significantly exceeds quarter of the length of the periphery of sleeve 2.

The tapered portion of each blade 3–6 preferably comprises a first planar portion 61–64 contiguous with portion 15–18 forming a hinge and extending substantially radially to missile 1 when the blade is in the folded position and a second curved portion 65–68 forming an extension of portion 61–64 respectively and located on the same side relative to the plane containing said portion 61–64. The concavity of portions 67,68 relative to the missile axis is reversed compared with the concavity of portions 65,66.

Blades 3 and 4 of one of the two pairs of blades, viewed in the direction of the longitudinal axis of missile 1 and in the opposite direction to the flight displacement of the tail unit have a visible or leading surface which is larger than that of blades 5,6 of the other pair. This increase in the surface area is brought about by folding a portion 55,56 of the rear curved part 65,66 of blade 3,4 towards the centre of curvature of the blade (FIGS. 2 and 3). This supplementary leading surface 55,56 which gives a rotation speed which is a function of the missile speed could naturally also be obtained by means of a member joined to blade 3,4 respectively.

In the longitudinal direction blades 3–6 are extended rearwards in known manner beyond the rear face of missile 1.

In the folded down position the overall dimensions of the tail unit according to the invention do not exceed those of the known tail unit, because the blades have a limited thickness and because two blades can be folded onto one another. In particular, the pivot angle of each blade about its axis advantageously exceeds 90°. Moreover, the angle $\pi$-$\alpha$ of the dihedron formed by each of the two half-planes passing through the missile axis and respectively through the pivot axis of each of the adjacent blades belonging to two different pairs and which are able to fold onto one another can exceed 90°, so that in the opened out position each blade can have a transverse dimension which significantly exceeds the width of quarter the circumference of the periphery of sleeve 2 whilst, in the folded down position, remaining at a very limited distance from the sleeve periphery.

Obviously the method for articulating the blades to the sleeve has only been described in an exemplified manner and any locking means and/or elastic resetting means for the blades can be used. The spacing of the blades 3,6 and 4,5 relative to the axial planes of symmetry X—X and Y—Y can also vary. The blades can also be given a different curvature.

The association of a circular arc portion 65–68 with a rectilinear portion 61–64 has only been given as an example. For example, each blade could have a regular curvature as for two adjacent blades the concavity of the curve is oriented in a different direction around the projectile axis and said two blades are symmetrical relative to the axial planes of the missile thus make it possible to change the sign of the lateral force four times per rotation, leading to a zero lateral force and thus preventing even at high speed an undesirable precession movement due to a linking of the yawing and pitching movements.

The number of pairs of curved blades can also be any even number exceeding two. For example, in the case of four pairs of blades two pairs would have their concavity turned in one direction, whilst the two other pairs alternating with the first pairs would have their concavity turned in the other direction, whereby each group of two pairs of blades would have two axial planes of symmetry.

The larger the overall dimensions and effective surface area of the blades the greater the stability which the tail unit according to the invention is able to give the missile. As can e.g. be seen in FIG. 2 in the opened out position each curved blade has a profile subtended by a chord whose length is significantly greater than the radius of the missile and can be close to the diameter of the missile and the overall dimensions of a tail unit opened out as in FIG. 2 can without difficulty be close to e.g. three times the missile diameter, i.e. having substantially the overall diameter of the tail unit in the folded down rest position.

Obviously various modifications and additions can be made by the Expert to the equipment described in non-limitative, illustrative manner hereinbefore without passing beyond the scope of the invention defined by the claims.

What is claimed is:

1. A tail unit for a missile which is propelled at supersonic speed of the type comprising a system of two pairs of curved blades, each blade having a longitudinal edge connected to the periphery of a cylindrical body, and means located on the missile blades for producing a rotary torque which rotates the tail unit in flight, each blade being pivoted about a pivot pin integral with the cylindrical body and located in the immediate vicinity of the periphery of the latter and having a curvature which substantially corresponds to that of the body, the length of the circular arc defined by the transverse profile of a blade being between one-quarter and one-half the length of the periphery of a cross-section of the cylindrical body, wherein the orientation of the concavity of the blades of one and the same pair of blades about the axis of the cylindrical body is opposite to that of the blades of the other pair of blades, the pivot pins of the blades of the same pair of blades are located in two diametrically opposite zones on the cylindrical body, and the blades can be folded down onto one another pairwise parallel to the outer surface of the body by rotation about said pivot pins.

2. A tail unit according to claim 1, wherein the blades of one pair of blades have a supplementary surface making it possible to produce a rotary torque which rotates the tail unit in flight.

3. A tail unit according to claim 2, wherein the blades of one pair have a visible surface, the area of which differs from the area of the visible surface of the blades of the other pair, when the blades are viewed in the direction of the longitudinal axis of the body and in the direction opposite to that of the normal displacement of the missile, so that in flight the tail unit rotates on itself.

4. A tail unit according to claim 2, wherein the leading edge of the blades of one pair of blades is chamfered.

5. A tail unit according to claim 2, wherein the blades of one pair have along their rear edge a portion or trailing edge folded from the side of the concave face of said blades.

6. A tail unit according to claim 1, wherein the blades are mounted on pivot pins inclined relative to the longitudinal axis of the missile so as to permit a deflection of the blades producing a rotary torque which makes the tail unit rotate on itself.

7. A tail unit according to claim 1, wherein each blade is mounted on the body on a pivot pin parallel to that of the body.

8. A tail unit according to claim 1, wherein it comprises means for locking the blades in the opened out position.

9. A tail unit according to claim 8, wherein each blade has on its edge connected to the cylindrical body at least one open recess which is entered by a fixed lug when the blade is in the opened out position and wherein elastic means are provided to maintain each opened out blade in a locked position with said lug engaged in the recess.

10. A tail unit according to claim 1, wherein the angle between the axial plane of the body passing through the pivot pins of two blades of the same pair and the axial plane of the body passing through the pivot pins of the two blades of the other pair differs by 90°.

* * * * *